United States Patent [19]

Hines

[11] Patent Number: 4,700,439

[45] Date of Patent: Oct. 20, 1987

[54] DRIVESHAFT FABRICATING APPARATUS

[75] Inventor: Gordon E. Hines, Ann Arbor, Mich.

[73] Assignee: Hines Industries, Inc., Ann Arbor, Mich.

[21] Appl. No.: 631,579

[22] Filed: Jul. 17, 1984

[51] Int. Cl.[4] ..... B21D 7/12

[52] U.S. Cl. ..... 29/33 T; 29/564.7; 72/386; 228/15.1

[58] Field of Search ..... 72/30, 34, 386, 710; 228/15.1, 18, 5.1, 141.1, 146, 155, 173.1, 173.4; 29/34 R, 234, 650, 282, DIG. 13, DIG. 24, DIG. 48, 564.1, 564.2, 564.7, 33 D, 33 K, 33 T; 82/DIG. 9; 73/66, 462

[56] References Cited

U.S. PATENT DOCUMENTS

| | | | |
|---|---|---|---|
| 1,231,650 | 10/1929 | Deloghia | 72/34 |
| 1,499,100 | 6/1924 | Eckstrom | 72/34 |
| 3,184,939 | 5/1965 | Eitel | 72/386 X |
| 3,316,743 | 5/1967 | Ovshinsky | 72/386 X |
| 3,713,312 | 1/1973 | Galdabini | 72/30 X |
| 3,805,624 | 4/1974 | Martin | 73/462 |
| 3,846,998 | 11/1974 | Lock | 72/386 |
| 4,061,006 | 12/1977 | Burns, Sr. | 72/34 |

FOREIGN PATENT DOCUMENTS

| | | | |
|---|---|---|---|
| 0112752 | 7/1984 | European Pat. Off. | 228/15.1 |
| 2207336 | 8/1973 | Fed. Rep. of Germany | 72/34 |
| 846202 | 7/1981 | U.S.S.R. | 228/15.1 |

*Primary Examiner*—Gil Weidenfeld
*Assistant Examiner*—Glenn L. Webb
*Attorney, Agent, or Firm*—Emch, Schaffer, Schaub & Porcello Co.

[57] ABSTRACT

A driveshaft fabricating apparatus is disclosed which achieves the functions of straightening, welding, straightening and balancing of a driveshaft workpiece without necessitating workpiece removal, reloading or otherwise disturbing the original set-up of the workpiece in the machine. The driveshaft fabricating apparatus includes a two-speed drive system, welding apparatus and electronic sensing apparatus for use in the balancing operation and the runout measurement operation. The driveshaft fabricating apparatus also includes a press assembly positioned for use in the straightening operation. During the straightening operation the workpiece is supported solely by the press assembly.

21 Claims, 16 Drawing Figures

DRIVESHAFT FABRICATING APPARATUS

BACKGROUND OF THE INVENTION

The present invention relates a driveshaft fabricating machine which is capable of straightening, welding, and balancing driveshaft assemblies without necessitating removal of the workpiece from the machine. The invention has particular application toward the fabrication of driveshafts which are composed of a shaft tube having pivoting universal joints positioned at each end.

Driveshaft fabrication generally requires six distinct procedures. These procedures include: (1) cutting the shaft tube to proper length; (2) installing tube fittings such as spline shafts or flange yokes by press-fit assembly; (3) measuring runout and straightening the unwelded workpiece; (4) welding the fittings to the shaft tube; (5) final measuring of runout and straightening of the workpiece to eliminate any weld-induced distortion; and (6) dynamic balancing. With the exception of the press-fit step of number (2), these operations all require rotation of the shaft or workpiece. Usually, a variety of machines are utilized to achieve each of the fabrication steps. For instance, tube cut off is accomplished through use of a hollow spindle lathe. The straightening step is accomplished by placing the workpiece in a straightener press which has a hydraulic ram member which presses against the workpiece to achieve radial alignment. The balancing operation requires a balancing machine having an intricate set-up of spindles, shafts and bearings to provide smooth high-speed rotation of the workpiece so that vibration sensors may pickup out of balance areas on the workpiece. The welding operation can be accomplished with any of the above machines, if the speed of rotation can be reduced and controlled sufficiently to provide a smooth weld bead between the tube shaft and the endpiece attached to the tube shaft.

It is desirable for enhancing manufacturing efficiency and time utilization to combine as many as the above-noted fabrication procedures as possible and perform a plurality of the steps on a single machine without need for additional set-ups. The most natural combination of operations would be welding and balancing since the welding may be readily performed with the balancer running at a rotational slow speed. In practice, however, it has been found to be necessary to straighten the workpiece after welding and before final balancing to remove any distortion produced by the weld stresses. Thus, if a balancer is used as a rotary welding fixture, the workpiece must still be removed from the machine for the straightening operation and replaced in the machine for balancing. The object of performing more than one fabricating operation on a single set-up is eluded. The workpiece must still be straightened prior to welding, removed from the straightening machine and placed in the balancing machine, welded, removed from the balancing machine and replaced in the straightening machine, and finally upon final straightening, replaced in the balancing machine for the balancing operation. This is undesirable.

It has also been found to be difficult to combine the straightening and balancing steps into a single machine. It is possible to equip the driveshaft balancer with the necessary sensors for measuring runout in the straightening process, however, because each runout measurement must be followed by requisite bending in a straightener press, such an adaptation still fails to reduce the number of set-ups required. The workpiece must be removed from the balancing machine and placed in a separate straightening press for the straightening operation because the fragile spindles and bearings of balancing machines as well as the machine bed, ways, and stanchions are not designed to withstand the high forces developed by a tube straightener press. Therefore, the straightener press must be a single dedicated machine separate from the balancer. Repeated loading and unloading of the workpiece between the balancer and the straightener press render the combination of a balancer and runout measurement impractical.

The present invention provides a unique machine which achieves the procedures of straightening, welding, straightening and balancing while the workpiece is set-up in a single machine. The present invention reduces the number of set-ups for the fabrication of a driveshaft from 6 to 3, namely: (1) tube cut off; (2) press-fitting; and (3) straightening, welding, straightening and balancing.

SUMMARY OF THE INVENTION

The present invention addresses the problems relating to achieving the straightening, welding, straightening and balancing of a driveshaft workpiece in one setup. The object of the present invention is to permit workpiece straightening while the workpiece is mounted in the balancing machine, thereby allowing the welding operation to also be performed while the workpiece is mounted in the balancing machine. The present invention facilitates all three operations repeatedly and in any sequence without necessitating workpiece removal, reloading or otherwise disturbing the one-time set-up in any manner.

The driveshaft fabricating apparatus of the present invention consists of an elongated bed member having a two-speed drive system, welding apparatus, and sensing apparatus for use in the balancing operation and the runout measurement operation. The driveshaft fabricating apparatus also includes a press assembly positioned on the bed member for use in the straightening operation. During the straightening operation, the workpiece is raised and supported solely by the press assembly. The drive system of the present invention is fixtured so that support for the workpiece can be transferred from the bearing block assemblies of the balancing machine to cradles which are firmly positioned on the bed member. As the workpiece is lifted off the balancing machine bearing blocks, no tube bending forces can be transmitted to the drive assembly, bearings and associated mechanisms. The press assembly retains all bending forces within the elements of its own structure. This aspect of the invention deletes the necessity of removal of the workpiece from the balancing/straightening machine thereby eliminating requisite repeat set-ups between the straightening, welding, and balancing procedure.

The press assembly of the present invention is mounted on linear or ball bearing slides designed to allow the press assembly to traverse the length of the driveshaft for positioning at locations of maximum runout. A deflection indicator with zero reset gives the operator a readout of actual deflection magnitude. A plurality of runout sensors are mounted proximate the workpiece and are moveable in a line parallel to the longitudinal axis of the workpiece. Thus, axial location as well as radial magnitude and angle of runout can be determined for proper positioning of the press assembly.

In the preferred embodiment of the present invention the runout sensors are proximity sensors of the non-contact eddy current type and are employed to generate a signal that, in conjunction with micro processor analysis, yields in averaging of surfaces fluctuations for true runout indication.

The present invention also includes a two drive system in which a speed reducer is engaged with the balancer spindle to slowing rotate the driveshaft workpiece for the purposes of achieving constant shaft rotation to help produce a uniform circumferential weld bead.

A micro processor is incorporated into the apparatus to complete the measurement and calculation functions for runout, unbalance and deflection of the workpiece when it is straightened.

FIG. *9a–9h* are series of schematic diagrams showing the relative position of various components of the driveshaft fabricating apparatus of the present invention during the different procedural steps of driveshaft fabrication.

DETAILED DESCRIPTION OF THE PREFERRED EMBODIMENT

The present invention relates a driveshaft fabricating apparatus which is capable of performing the operations of straightening, welding, straightening and balancing of a driveshaft workpiece, repeatedly if necessary, while necessitating only one set-up of the workpiece in the machine.

Figure 1:
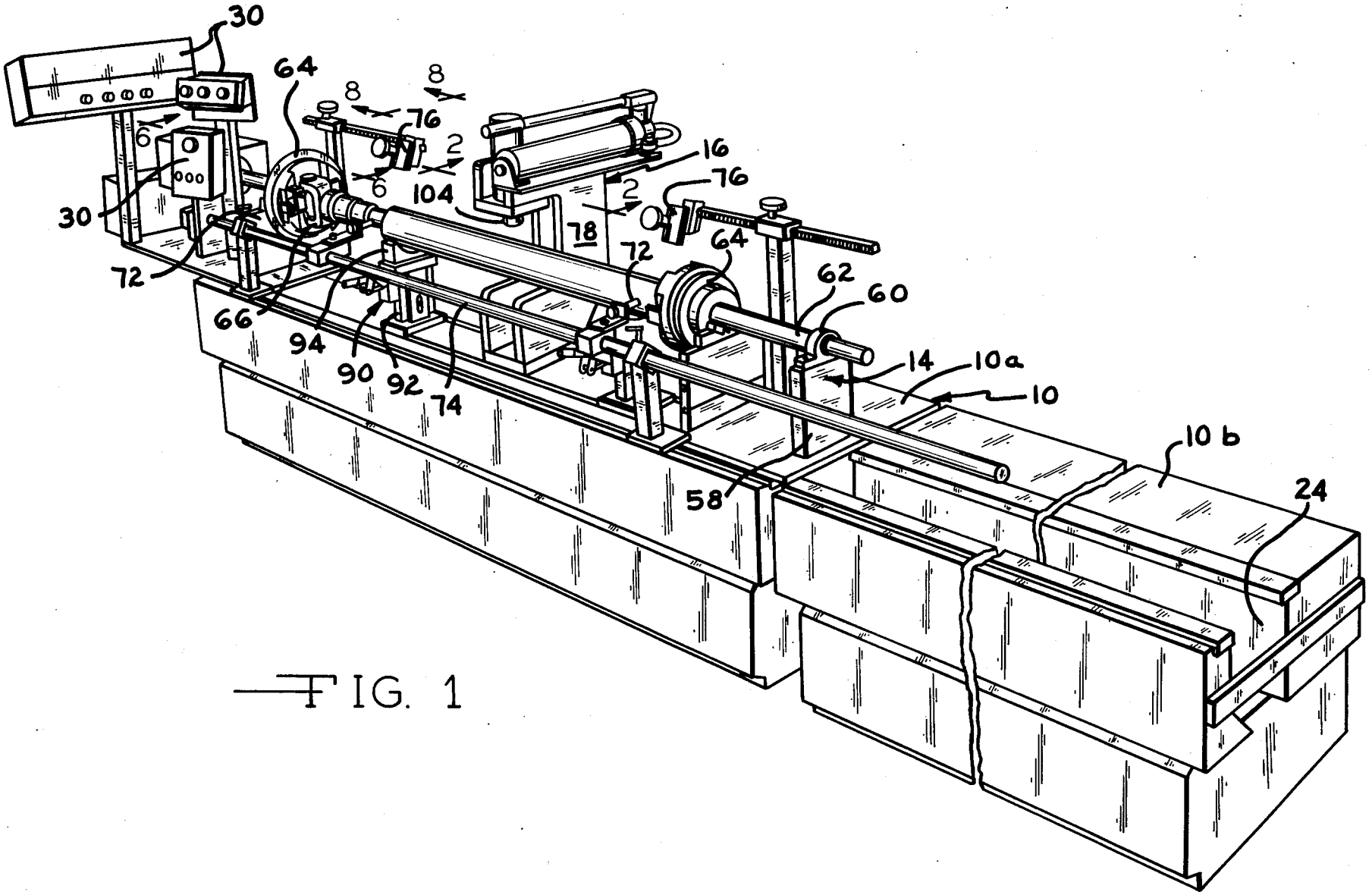
FIG. 1 is a perspective view of the driveshaft fabricating apparatus of the present invention.
Figure 2:
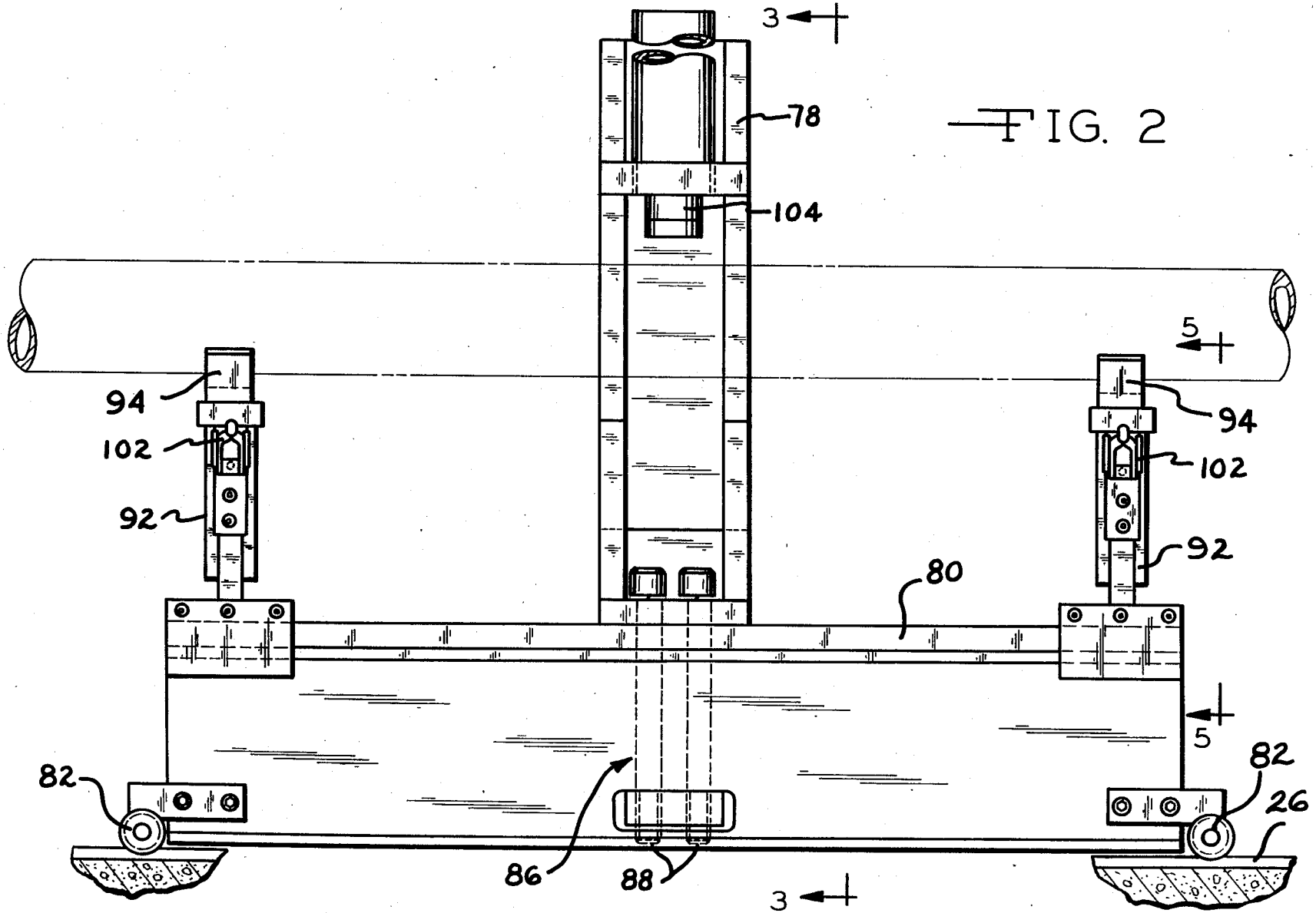
FIG. 2 is a partial elevational view of the press assembly of the driveshaft fabricating apparatus of the present invention taken along line 2—2 of FIG. 1.
Figure 3:
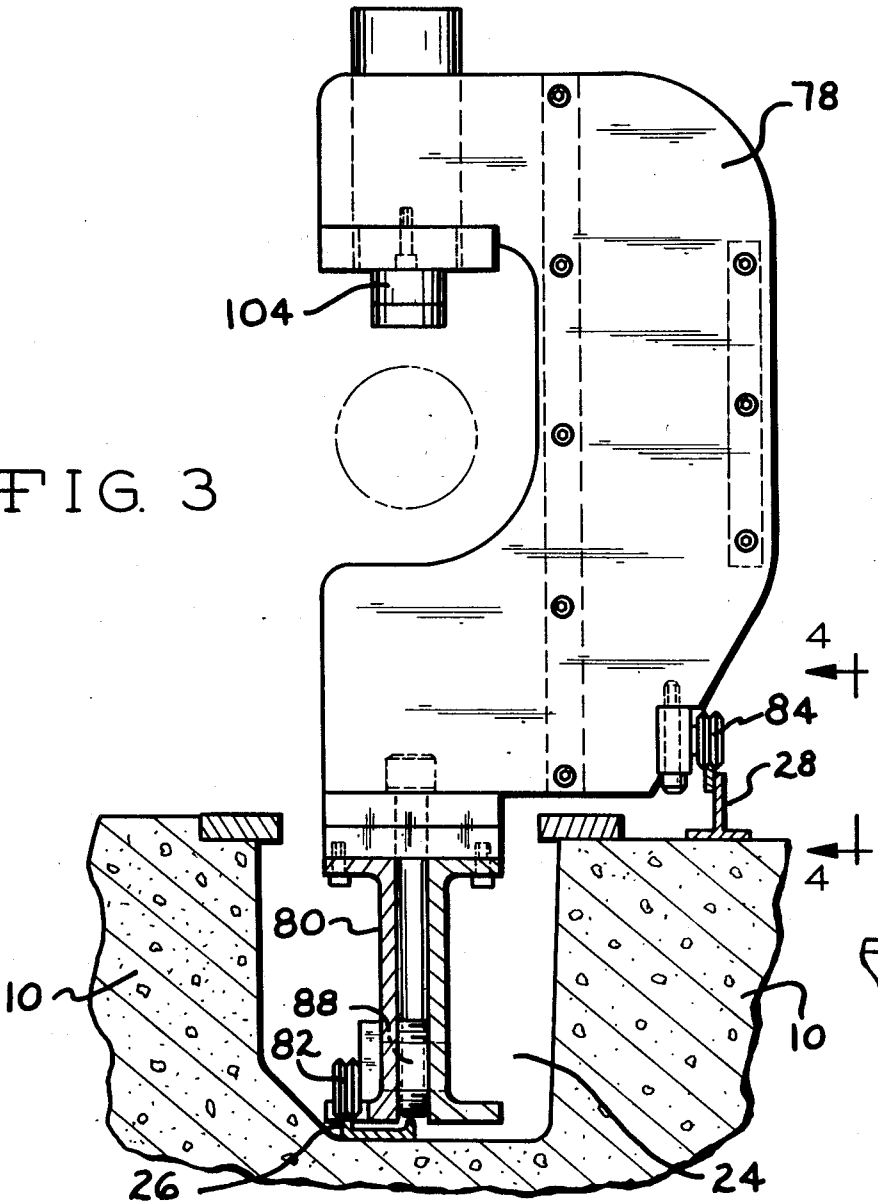
FIG. 3 is a cross-sectional view of the press assembly of the driveshaft fabricating apparatus of the present invention taken along line of 3—3 of FIG. 2.

Referring now to FIG. 1, the driveshaft fabricating apparatus of the present invention has a bed member 10 which supports a drive system 12, at least two bearing block assemblies 14, and a press assembly 16. Also mounted on the bed member 10 are vibration sensors 18, proximity runout sensors 72 and welding guns 22. The bed member 10 is divided into two units 10*a*, 10*b*, and is constructed of heavy duty concrete and steel. A longitudinally extending channel 24 runs the length of the bed members 10*a*, 10*b*, and a first rail member 26, as shown in FIG. 3, is located in the bottom of the channel 24 and runs the fully length of the channel 24. As second rail member 28 is located on the top surface of the bed member 10 and extends parallel to the first rail member 26.

As shown in FIG. 1, a microprocessor and a variety of control/readout units 30 are located at one end of the bed member 10. These units 30 together with the sensors are used to measure and calculate the amount of unbalance in the workpiece being processed, the amount of runout for the straightening process, and the amount of deflection of the workpiece during operation of the press assembly.

Figure 6:
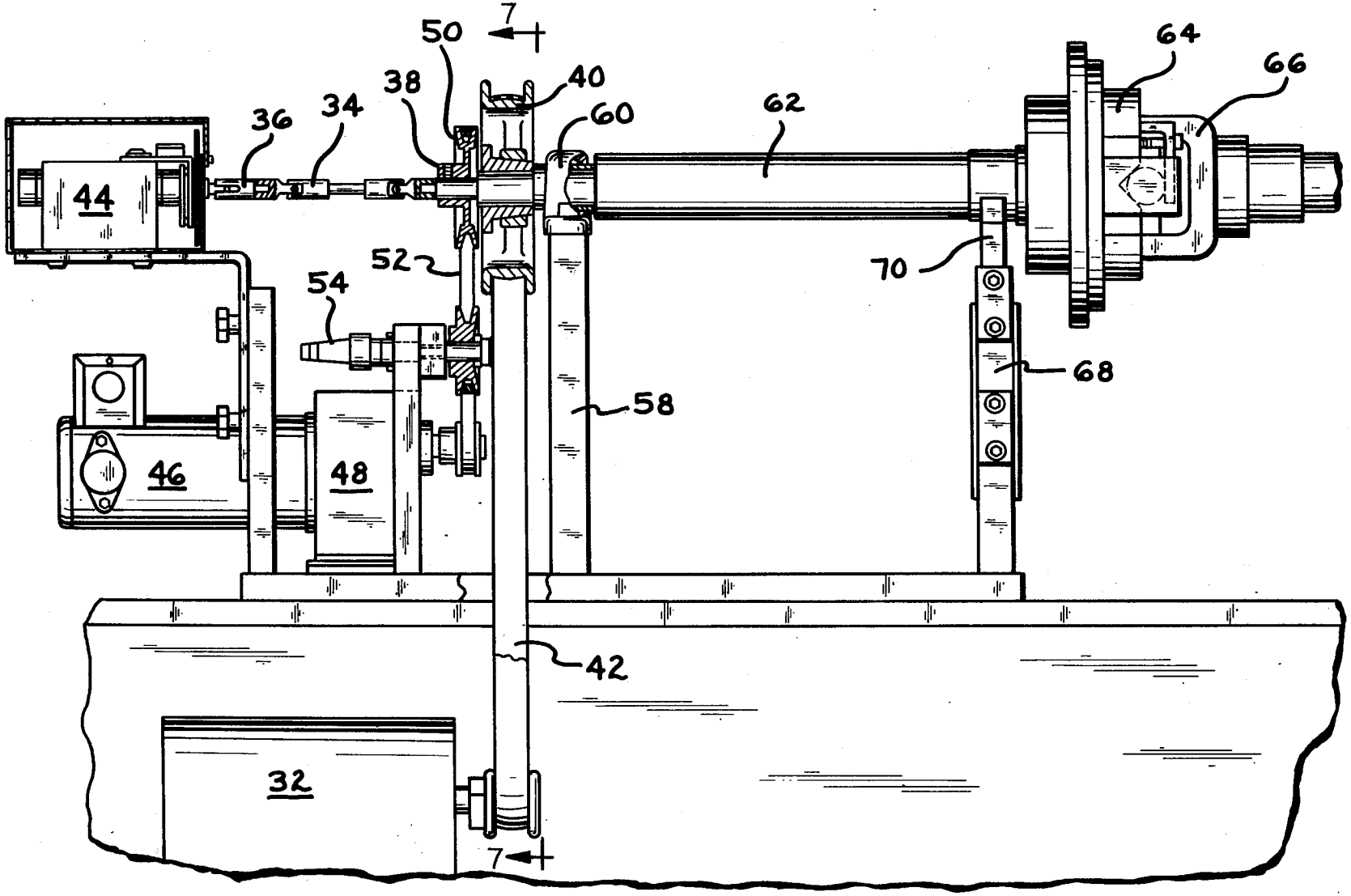
FIG. 6 is a detailed view of the drive system of the driveshaft fabricating apparatus of the present invention.
Figure 7:
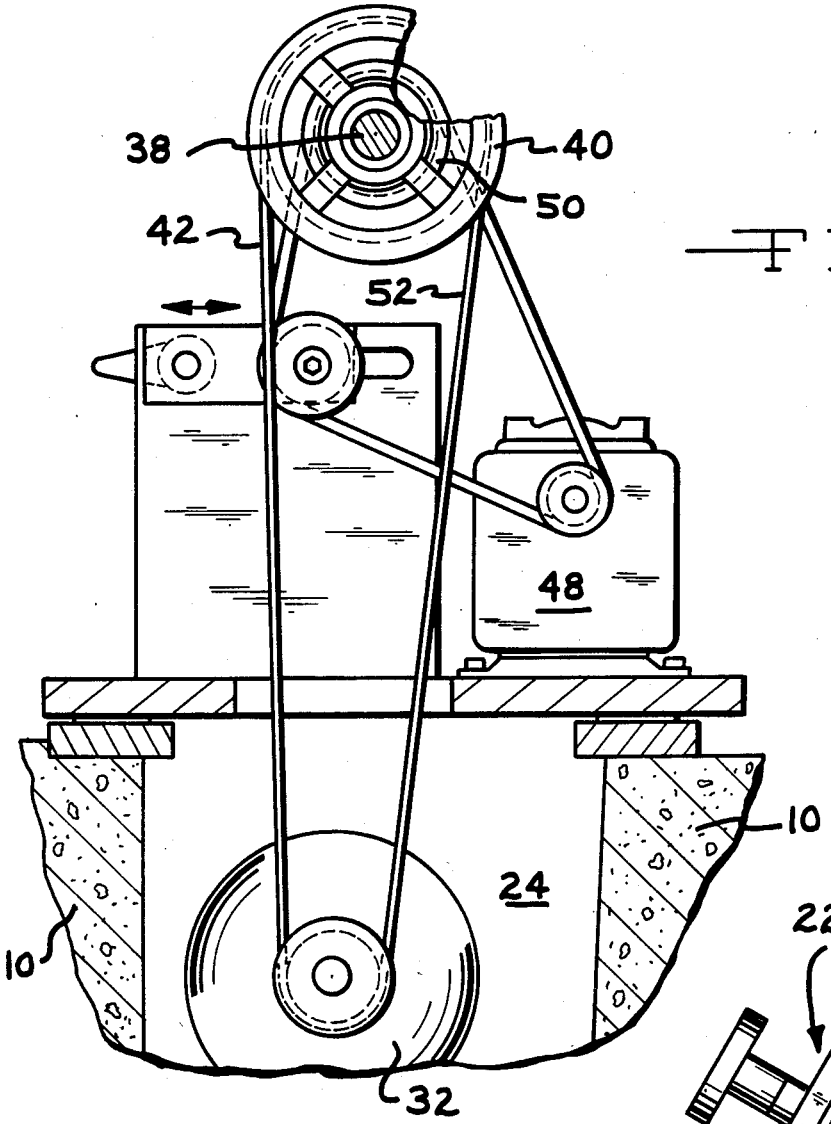
FIG. 7 is a detailed view along lines 7—7 of FIG. 6.
Figure 8:
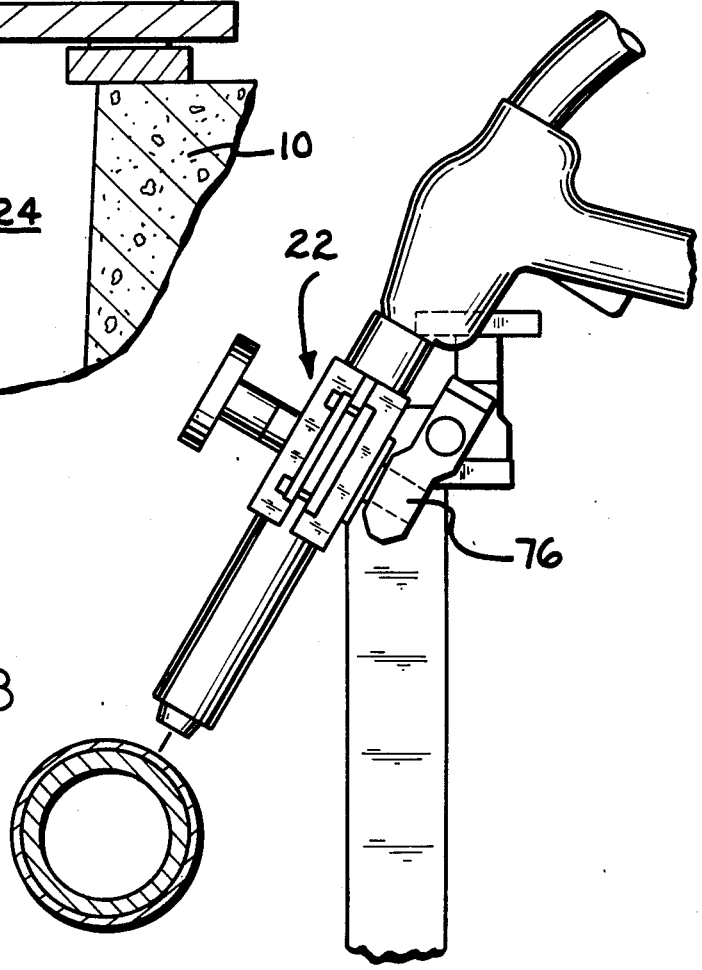
FIG. 8 is a detailed view of the welding guns of the driveshaft fabricating apparatus of the present invention.

Referring now to FIGS. 6 and 7, the drive system 12 of the present invention will be described. An AC motor 32 is mounted in the channel 24 and is intended to provide the drive for the balancing operation. A speed control unit 24 is positioned on the bed member 10 above the AC motor 32. A spindle shaft 34 is mounted in a self-aligning bearing 36 which engages the speed control unit 24. The opposed end of the spindle shaft 34 is attached to a drive member 38. The drive member 38 includes a first pulley 40. A drivebelt 42 connects the AC motor 32 with the first pulley 40. In the preferred embodiment, the AC motor 32 applies a drive force to the drive member 38 and a speed control unit 44 measures the rotational speed of the spindle shaft 34 and precisely controls that rotational speed to 500 RPM for the balancing operation. A second motor 46, preferably a gear motor, is also in communication with the drive member 38. The gear motor 46 is used during the welding operation and is an adjustable speed motor. In the preferred embodiment, the gear motor 46 is in communication with a gear reducer 48 to provide the proper speed of rotation to the workpiece for welding operations. A second pulley 50 is mounted on the drive member 38 and is in communication with the gear reducer 48 by a second drivebelt 52. In the preferred embodiment, a tensioning device 54 is also in communication with the second drivebelt 52. The tensioning device 54 is used to loosen the tension in the second belt and thereby engage and disengage the motor driven gear reducer 48 from applying rotational forces to the second pulley 50. In the preferred embodiment, the first and second motors are electronically interlocked and are mutually exclusive in operation.

Referring now to FIGS. 1 and 6, the present apparatus includes bearing block assemblies 14*a* and 14*b* which provide firm support for the rotating workpiece. Each bearing block assembly 14*a*, 14*b* consists of a support member 58 positioned on the bed member 10 and a bearing assembly 60 mounted on top of the support member 58. One bearing block assembly 14*b* is longitudinally moveable along the length of the bed member 10 so that driveshaft workpieces of varying lengths can be fabricated. Each bearing block assembly 14*a*, 14*b* includes a shaft member which is mounted for rotation in the bearing assembly 60. The shaft member 62 of the bearing block assembly 14*a* located proximate the drive assembly 12 is attached to the drive member 38 and is rotationally driven by the drive member 38.

Each shaft member 62 includes a workpiece mounting tool 64. The workpiece mounting tool is adapted to receive the driveshaft endpiece and securely position the workpiece for rotation. In the preferred embodiment, the workpiece mounting tools 64 are adapted to receive the flange yokes 66 of a universal endpiece.

Referring now to FIGS. 1 and 6, vibration sensors are located proximate each workpiece mounting tool and are in communication with each shaft member 62. The vibration sensors are located in V-block bearing units 70 which engage the shaft members 62. The vibration sensors 68 measure the amount of rotational vibration during balancing operations and transmits the vibration signals to the microprocessor unit 30 for evaluation.

Proximity sensors 72 are positioned adjacent the rotating workpiece. The proximity sensors 72 are mounted on a railing 74 which extends the length of the bed member 10. The proximity sensors 72 simultaneously measure both ends of the rotating workpiece and relay information to the microprocessor 30 delineating the amount and phase of the runout of the rotating workpiece. The proximity sensors 72 are slideable on the railing 74 enabling them to move across the length of the rotating workpiece in order to measure areas of radial misalignment on the workpiece. The sensors and the microprocessor are designed to average out weld seam, ovality characteristics, and other tube irregularities and determine the actual amount and angles of tube runouts. The signals received by the proximity sensors 72 are processed through the microprocessor control unit 30.

The welding guns 22 are mounted on welding gun support brackets 76 which are positioned at the rear of the bed assembly. The welding gun support brackets 76 are adjustable to allow the welding guns to position proximate the joinder of the driveshaft tube and driveshaft endpieces to accomodate workpieces of varying lengths, radii and sizes.

Referring now to FIGS. 2, 3, 4 and 5, the press assembly 16 of the present invention will be described. The press assembly 16 consists of a C-frame body member which extends perpendicularly above the bed member 10. An elongated beam member 80 is fixed to the bottom of the C-frame body member 78. First and second roller bearings 82 are located at each end of the beam member 80 and a third roller bearing is located on the C-frame body member 78 proximate the back of the body member 78. The press assembly 16 is positioned on the bed member 10 by placing the first and second roller bearing 82 in communication with the first rail member 26 and placing the third roller bearing 84 in communication with the second rail member 28. The press assembly 16 is then free to move longitudinally on the rail member 26, 28 along the length of the bed member 10 to facilitate proper placement of the press assembly for straightening operations. Also incorporated in the beam member 80 is a braking member 86 which comprises, in the preferred embodiment, two bolt members 88 which are threaded through the beam member 80 and can be tightened into communication with the first rail member 26 to prevent movement of the press assembly 16 on the first rail member 26.

At least two workpiece support stanchions 90 are positioned on the beam member 80. Each workpiece support stanchion 90 includes a body member 92 which is fixed to the beam member 80. Each workpiece support stanchion also includes a cradle member 94 which is engaged with the body member 92 and can be elevated with respect to the body member 92 to engage and support the workpiece during pressing operations. In the preferred embodiment, the cradle member 94 is adapted to receive cradle inserts 56 of varying radii. This enables the cradle 94 to securely support workpieces of varying size configurations during pressing operation.

Figure 5:
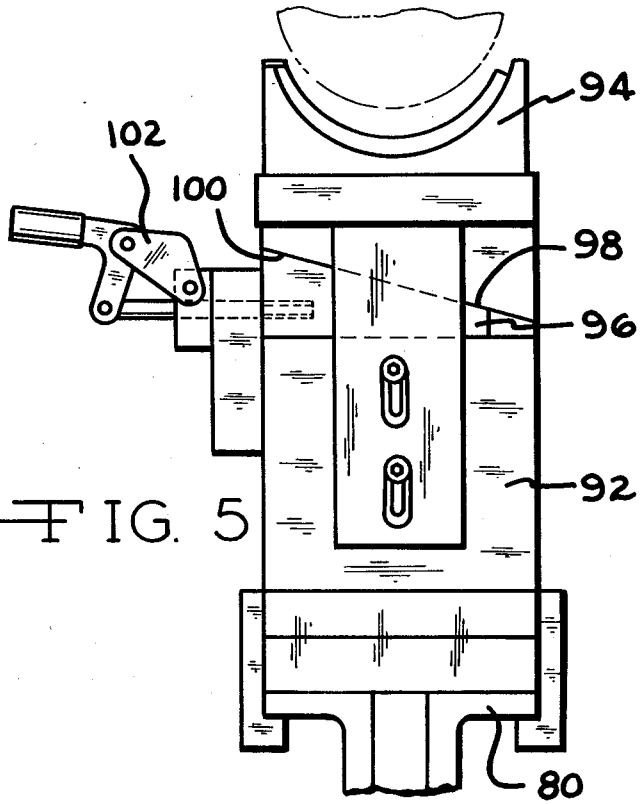
FIG. 5 is a detailed view of the workpiece support stanchion of the press assembly of the driveshaft fabricating apparatus of the present invention taken along the line 5—5 of FIG. 2.
Figure 4:
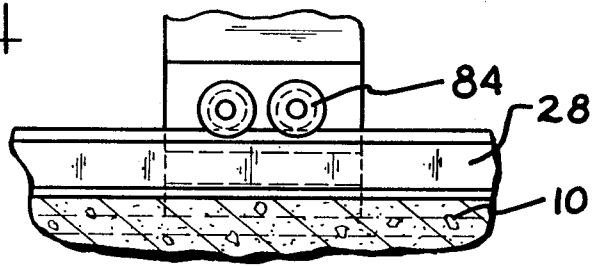
FIG. 4 is a detailed view of the roller apparatus of the press assembly of the driveshaft fabricating apparatus of the present invention taken along line 4—4 of FIG. 3.

Referring now to FIG. 5, a wedge member 96 is disposed between the cradle member 94 and body member 92. The wedge member 96 has an inclined face 98 for communication with a coincident inclined face 100 located on the cradle member 94. As the wedge member 96 is moved laterally with respect to the body member 92 and the cradle member 94, the inclined face 98 of the cradle moves with the inclined face 100 of the wedge causing the cradle member to elevate and engage and support the workpiece, thereby removing all stresses from the bearing block assemblies 14 and the V-block bearing assemblies 70. An over center locking member 102 fixes the cradle in the desired elevated position for supporting the workpiece during pressing operations. The pressing apparatus consists of a hydraulic ram mounted on the upper-most portion of the C-frame body member 78. Included with the hydraulic ram 104 is an electronic sensor which measures the downward travel of the ram after contact with the driveshaft tubing and transfer that measurement to the microprocessor for comparison with the data produced by the proximity sensors 72.

The main information input device in the microprocessor is a 16 channel multiplexed analog to digital converter. It samples the unbalance signals as described above and converts the value to digital form. This converter, however, can read steady DC voltages as well and it is used to read the parameter set by the operator at the front control panels of the unit 30. In a computer based balancing, runout, and straightening machine, it is necessary to input several parameters to the computer for the purpose of establishing the operating mode.

The A/D converter is to read the position of multiposition switches thereby selecting the desired operating mode or any combination thereof. If for example a 6-position switch is to be used to select one of the operating modes of balancing in two planes, balancing in three planes, runout, and runout-ram operations, five equal resistors are connected between successive poles of the switch. The counter-clockwise pole is then connected to ground, and the clockwise one to the reference voltage. The integer output of the A/D converter is then multiplied by the number of poles minus 1, and divided by the full scale value. E.g., for a 6-position switch, the output is multiplied by 5/255. The resulting value is rounded to the nearest value (not truncated), and the resulting number in the range of 0 to 5 corresponds to the switch position.

These techniques result in minimum interconnecting wiring between the front panel of the electrodes and the computer. One wire is required for each potentiometer and switch, plus two wires (ground and reference voltage) that are common to all front panel controls. Resistors with a tolerance of 5% will be adequate for switches up to about 8 poles. This technique is particularly useful since A/D converters are available with multipolexed inputs (up to 16 or more) that are switch selectable by computer control. The computer may then by simple software "read" all of the controls on the front panel. The computer also functions to automatically select the operating mode according to signals received from the various sensors relating the rotational speed of the workpiece.

The microprocessor provides the measurement and calculation functions for runout measurement, unbalance, and deflection of a driveshaft during the straightening operations. Unbalance is measured by sampling the signal from each of the unbalance vibration sensors 68 thirty-two times per revolution of the workpiece. The signals are amplified and filtered previous to sampling. Samples for each of the 32 sample points, counted from a reference point on the workpiece are summed for 32 revolutions of the part. This summing provides some signal averaging that is equivalent to passing the signal through a tuned filter. The advantage of this method of filtering is that the center frequency of the filter exactly matches the rotational speed of the workpiece. The averaged signal is then processed by performing a cross-correlation calculation with a sine and a cosine function. The resulting values are the quadrature amplitude values from which a polar representation of the signal is calculated. This cross-correlation calculation provides additional filtering to remove unwanted signals from the measured values. The overall response to the present invention is such that all harmonics present in the measured values are removed. This calculation is sometimes referred to in the art as a first harmonic measurement. The calculation is essentially the same as calculating the fundamental frequency content of a periodic signal by means of a Fourier analysis.

The runout signals are treated in the same manner, except that, since the signals are not a function of speed, measurement is made as the workpiece is accelerating to its running speed. Also, since the signal is not as noisy, only eight revolutions worth of data is averaged. The runout proximity sensors 72 are non-contacting, and operate on an eddy current loss principle. They have their own signal conditioning electronics that linearizes the output of the sensor over the range of 0.05 inches to 0.5 inches, so that the operator can estimate a gap of $\frac{1}{8}$ to 3/16 inches when setting the sensors in place. Any signal within the linear range of the proximity sensors will give valid runout results since the signal calculation throws away the average distance from sensor shaft and only calculates the first harmonic component as described above.

The converter of the microprocessor also reads the potentiometer sensor that senses the position of the ram member as it pushes on the driveshaft workpiece. The operator lowers the ram until it touches the workpiece and presses a zero button which reads the potentiometer voltage and subtracts it from all subsequent readings. The converter output is again multiplied by a suitable scale factor so that the deflection may be displayed in increments of 0.005 inches.

Figure 9A:
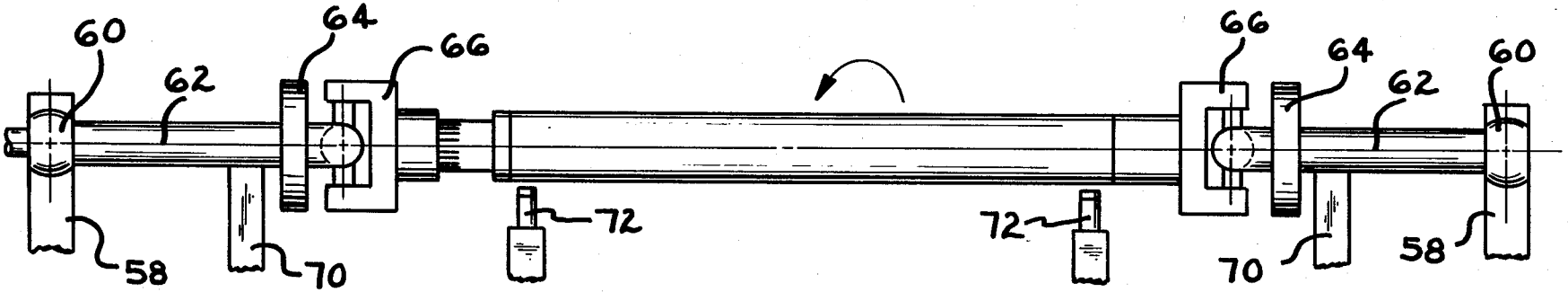

Referring now to FIGS. 9*a* through 9*h*, the operation of the driveshaft fabricating device of the present invention will be described. Referring to FIG. 9*a*, the workpiece is shown as a driveshaft with two universal joints attached to the end of the driveshaft. The bearing block assemblies 14 are supporting the workpiece through the shaft members 62 and the workpiece mounting tools 64. The shaft is being rotated and proximity sensors 72 are being moved along the longitudinal axis of the workpiece to sense any out of tolerance bends within the workpiece. As the workpiece is being rotated, the proximity sensors 72 and the microprocessor unit 30 detects out of tolerance bends and informs the operator by referring to the control panels of the unit 30 as to the amount and location of such out of tolerance bends. The operator then positions the press assembly 16 at the proper location and readies the workpiece for a pressing operation.

Figure 9B:
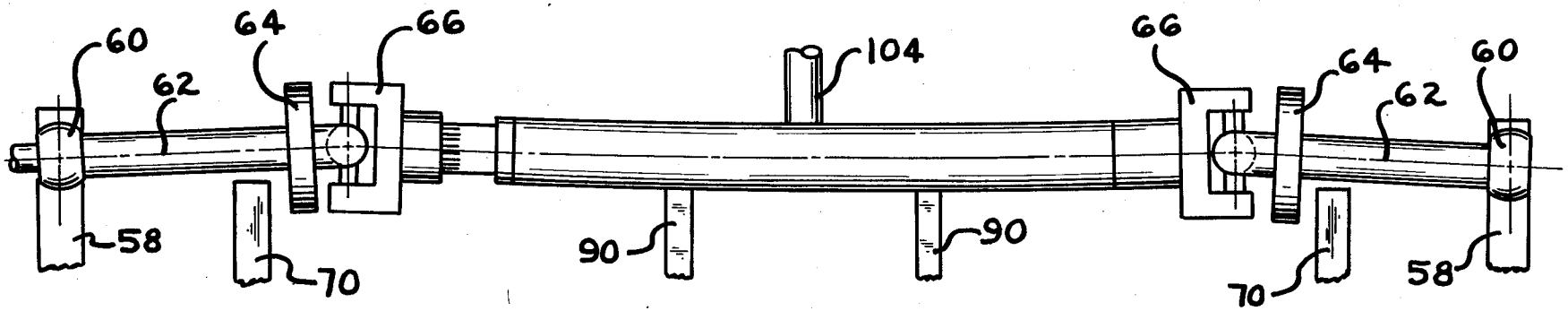

Referring now to FIG. 9*b*, the press assembly is shown in operation. It can be seen that the cradles 94 have engaged and are supporting the workpiece, lifting it off of vibration sensors 68 and removing support stresses from the bearing block assemblies 14. It can be seen from FIG. 9*b* that the bearing assemblies 60 of the bearing block assemblies 14 are rotational bearing members which allow the workpiece to be angled without disturbing the original set-up. The ram member 104 can then be operated to deflect the workpiece and remove any out of tolerance bends from the driveshaft. The cradle members 94 will support the workpiece during operation of the ram member 104.

Figure 9C:
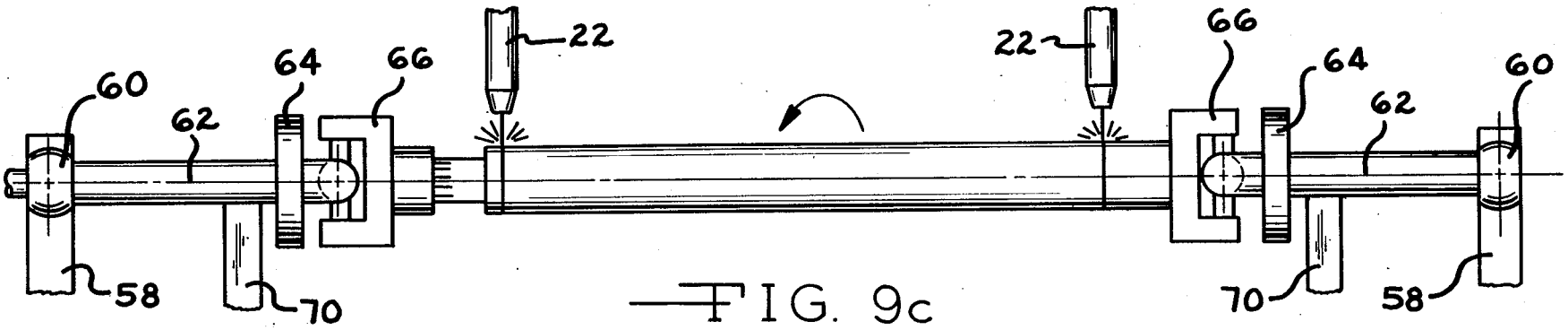

Referring now to FIG. 9*c*, the first straightening operation is finished and the workpiece is once again being fully supported by the bearing block assemblies 15. The universal joints are being welded to the driveshaft by welding guns 22.

Figure 9D:
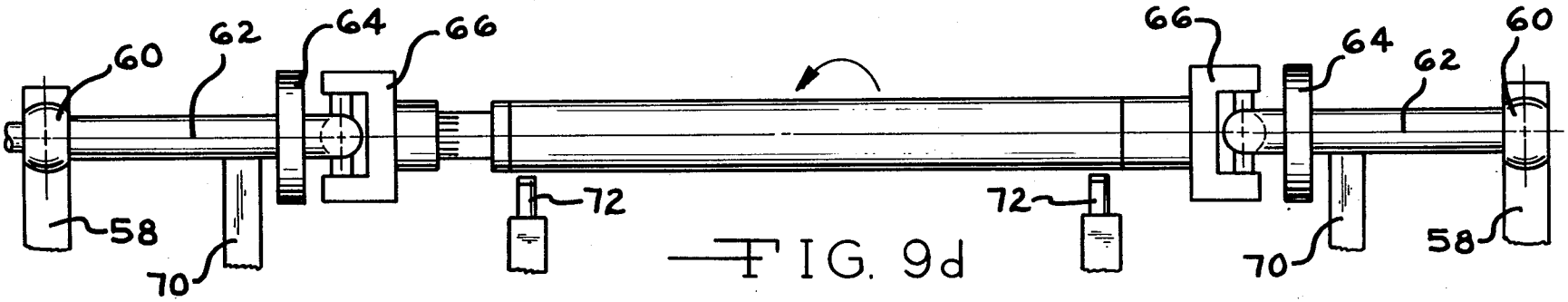
Figure 9E:
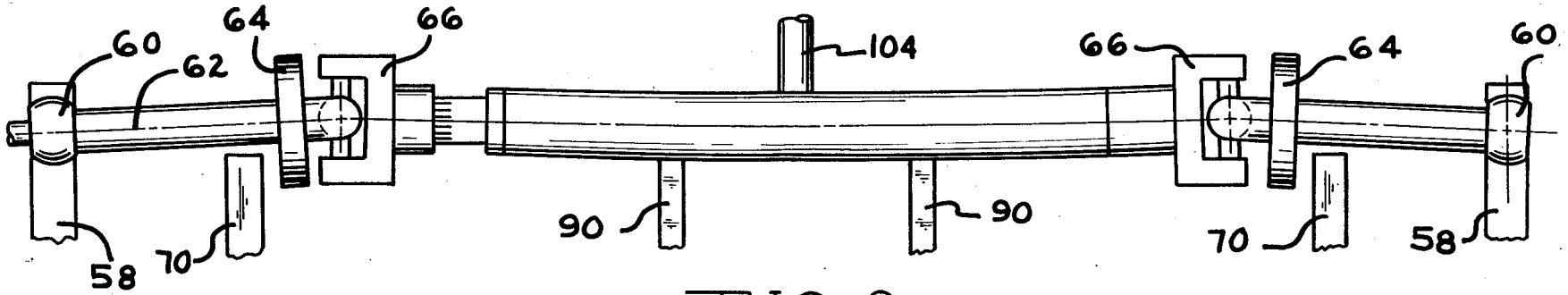

Referring now to FIG. 9*d*, the driveshaft is again being rotated and the proximity sensors 72 are again searching for any out of tolerance bends in the workpiece due to the welding stresses. If out of tolerance bends are found, the workpiece will once again be straightened using the press assembly as shown in FIG. 9*e*.

Figures 9F, 9G, 9H:
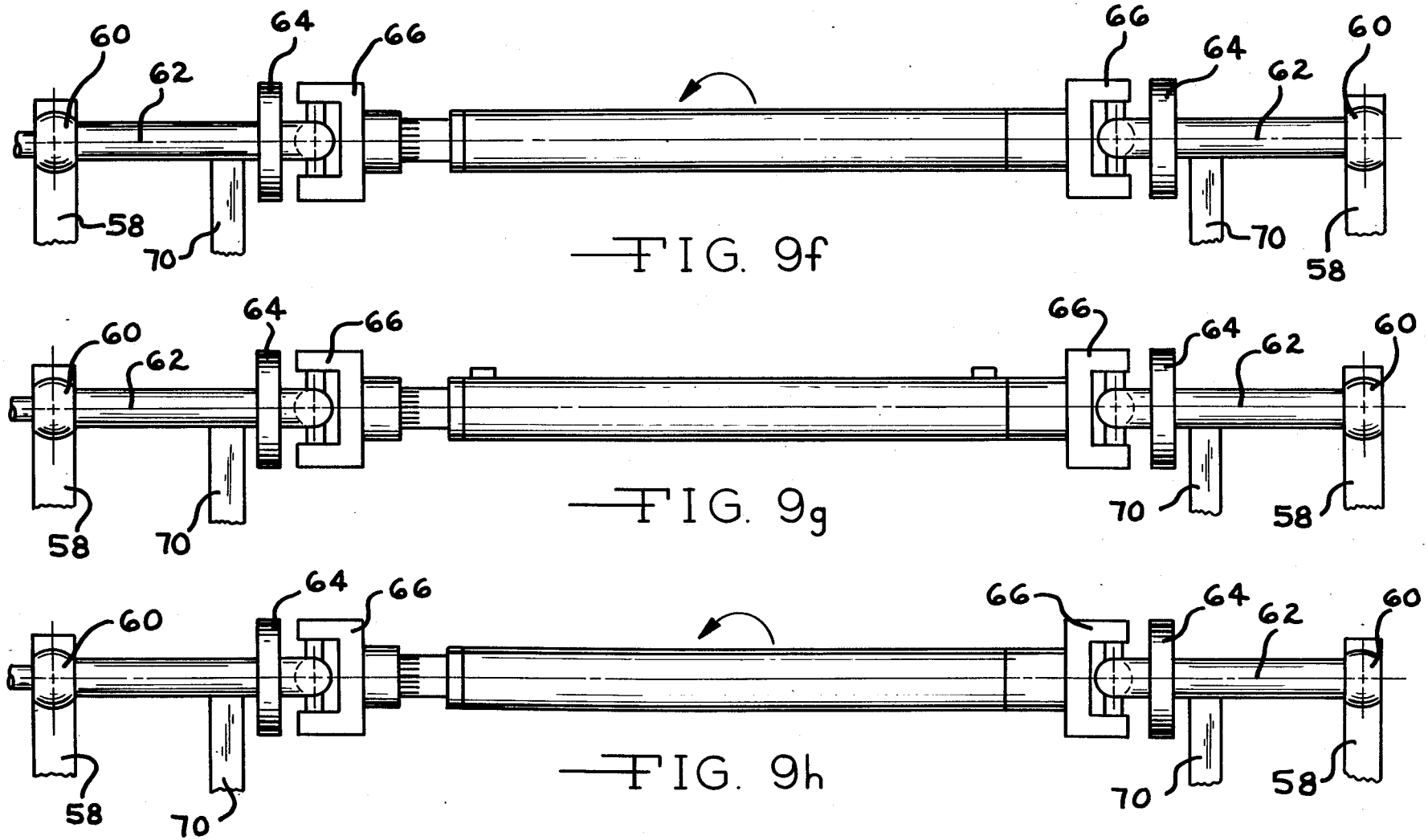

Referring now to FIG. 9*f*, *g*, and *h*, the balance operation and weight adding operations are shown. The workpiece is once again in communication with the vibration sensors 68 located in the V-block bearings 70. The vibration sensors 68 received input of any unbalance of the rotating workpiece. The microprocessor unit 30 receives the signals from the vibration sensors 68 and informs the operator of the angle and area of such unbalance so that the operator may accurately add weight (FIG. 9*g*) to the workpiece to remove any unbalance conditions.

It can be seen that the present invention accomplishes its objective of facilitating the processes of workpiece straightening, welding and balancing repeatedly and in any sequence without necessitating workpiece removal or reloading in any manner. The drawings and descriptions of the preferred embodiment are not intended to be limiting on the scope of the invention as set forth in the following claims.

What I claim:

1. A driveshaft fabricating apparatus for finishing workpiece composed of a driveshaft tube and a driveshaft endpiece installed on such driveshaft tube comprising, in combination:

a first elongated bed member;

driving means for rotating such workpiece located proximate one end of said first bed member;

support means positioned on said first bed member for supporting such rotating workpiece;

longitudinally adjustable sensor means adjacent such rotating workpiece for sensing the presence and location of any radial misalignment along the longitudinal axis of such rotating workpiece; and, press means including a second bed member positioned on said first bed member for longitudinal movement with respect to such workpiece and said first bed member, at least two workpiece support stanchions, each stanchion mounted on said second bed member for longitudinal movement with respect to such workpiece and a press assembly for applying a radially deflecting force to such workpiece to eliminate such radial misalignment, wherein said stanchions are positionable in close proximity to such area of radial misalignment and said stanchions and said second bed member absorb the forces applied to such workpiece during operation of said press assembly.

2. The driveshaft fabricating apparatus of claim 1, further comprising welding means positioned on said first bed member for applying a weld bead to such driveshaft endpiece installed on such driveshaft tube.

3. The driveshaft fabricating apparatus of claim 1, wherein said press assembly includes a ram member and means for operating said ram member to apply a predetermined radially deflecting force to such workpiece.

4. The driveshaft fabricating apparatus of claim 3, wherein said workpiece support stanchions include a body member fixed to said second bed member, a cradle in communication with said body member, said cradle being moveable with respect to said body member for engaging and supporting such workpiece, and means for elevating said cradle into sole supporting communication with such workpiece during operation of said ram member.

5. The driveshaft fabricating apparatus of claim 4 wherein said means for elevating said cradle includes: a wedge member in communication with said body member and said cradle, said wedge member being disposed for lateral movement between said body member and said cradle for elevating said cradle; and means for locking said cradle in a desired elevated position.

6. The driveshaft fabricating apparatus of claim 5 wherein said cradle engages a face of said wedge member having an inclined disposition with respect to said body member whereby said cradle moves between elevated positions as said wedge member is moved between said body member and said cradle.

7. The driveshaft fabricating apparatus of claim 4 wherein said cradle includes a plurality of removable inserts, each of said removable inserts being of a different radius for engaging and firmly supporting workpieces having varying radii.

8. The driveshaft fabricating apparatus of claim 4 wherein said cradle engages such workpiece and provides sole support for such workpiece during operation of said ram member.

9. The driveshaft fabricating apparatus of claim 3 further including means for controlling the amount of deflection in such workpiece during operation of said ram member.

10. The driveshaft fabricating apparatus of claim 3 wherein said first bed member includes a longitudinally extending channel, a first rail member positioned in said channel, a second rail member positioned on said first bed member proximate said channel and parallel to said first rail member; said second bed member includes first roller means for engaging said first rail, said press assembly includes second roller means for engaging said second rail, and means for securing the position of said press means with respect to such workpiece during operation of said press assembly.

11. A driveshaft fabricating apparatus for finishing a workpiece composed of a driveshaft tube and a driveshaft endpiece installed on such driveshaft tube comprising in combination:

a first elongated bed member:

driving means for rotating such workpiece located proximate one end of said first bed member;

support means positioned on said first bed member for supporting such rotating workpiece;

first sensor means positioned on said first bed member adjacent such rotating workpiece for determining the presence and location of any radial misalignment along the longitudinal axis of such rotating workpiece;

second sesor means in communication with such rotating workpiece for determining the presence and location of any rotational unbalance of such rotating workpiece;

a second bed member positioned for movement on said first bed member; and press means positioned on said second bed member for applying a radially deflecting force to such workpiece to eliminate such radial misalignment, said press means including a ram member and third sensor means for determining the amount of radially deflecting forces being applied by said ram member to such workpiece.

12. A driveshaft fabricating apparatus for finishing a workpiece composed of a driveshaft tube and a driveshaft endpiece installed on such driveshaft tube comprising, in combination:

a first elongated bed member;

driving means for rotating such workpiece located proximate one end of said first bed member;

support means positioned on said first bed member for supporting such rotating workpiece;

longitudinally adjustable sensor means positioned adjacent such rotating workpiece for sensing the presence and location of any radial misalignment along the longitudinal axis of such rotating workpiece;

a vibration responsive second sensor means for locating areas of radial inbalance on such rotating workpiece; and, press means including a second bed member positioned for longitudinal movement on said first bed member, at least two workpiece support stanchions mounted for movement on said second bed member and a press assembly for applying a radially deflecting force to such workpiece to eliminate such radially misalignment.

13. The driveshaft fabricating apparatus of claim 12, wherein said driving means includes a first motor having a first rotational speed, a second motor means having a second rotational speed, and a driving member in communication with said first and second motor means and being independently rotationally driven at said first or second rotational speeds.

14. The driveshaft fabricating apparatus of claim 13, wherein said second motor means includes a speed varying means for adjusting the rotational speed of such workpiece.

15. The driveshaft fabricating apparatus of claim 13, wherein said support means includes two bearing blocks assemblies positioned on said first bed member with a first bearing block assembly located proximate said driving member, a first member mounted for rotation on said first bearing block assembly, one end of said first shaft member in communication with said driving member and the opposed end of said shaft member adapted for receiving such workpiece, said remaining bearing block assembly spaced from said bearing block assembly, and a second shaft member mounted for rotation on said second shaft member being adapted to receive such workpiece, whereby such workpiece is mounted for rotation between said first shaft member and said second shaft member.

16. The driveshaft fabricating apparatus of claim 14, wherein said second bearing block assembly is longitudinally moveable with respect to said first bed member.

17. A driveshaft fabricating apparatus for finishing a workpiece composed of a driveshaft tube and a driveshaft endpiece installed on such driveshaft tube comprising, in combination:

a first elongated bed member;

driving means for rotating such workpiece located proximate one end of said first bed member;

support means positioned on said first bed member for supporting such rotating workpiece;

longitudinally adjustable sensor means positioned adjacent such rotating workpiece for sensing the presence and locating of any radial misalignment along the longitudinal axis of such rotating workpiece;

a vibration responsive second sensor means for locating areas of radial imbalance on such rotating workpiece;

welding means positioned on said first bed member for applying a weld bead to such driveshaft endpiece installed on such driveshaft tube; and, press means including a second bed member positioned for longitudinal movement on said first bed member, at least two workpiece support stanchions mounted for movement on said second bed member and a press assembly for applying a radially deflecting force to such workpiece to eliminate such radial misalignment.

18. The driveshaft fabricating apparatus of claim 17, wherein said driving means includes a first motor means having a first rotational speed, a second motor means having a second rotational speed, and a driving member in communication with said first and second motor means and being independently rotationally driven at said first or second rotational speeds.

19. The driveshaft fabricating apparatus of claim 18, wherein said second motor means includes a speed varying means for adjusting the rotational speed of such workpiece.

20. The driveshaft fabricating apparatus of claim 18, wherein said support means includes two bearing block assemblies positioned on said first bed member with a first bearing block assembly located proximate said driving member, a first shaft member mounted for rotation on said first bearing block assembly, one end of said first shaft member in communication with said driving member and the opposed end of said first shaft member adapted for receiving such workpiece, said remaining bearing block assembly spaced from said first bearing block assembly, and a second shaft member mounted for rotation on said second bearing block assembly, said second shaft member being adapted to receive such workpiece, whereby such workpiece is mounted for rotation between said first shaft member and said second shaft member.

21. The driveshaft fabricating apparatus of claim 19, wherein said second bearing block assembly is longitudinally moveable with respect to said first bed member.

* * * * *